US007835657B2

(12) United States Patent
Kyung et al.

(10) Patent No.: US 7,835,657 B2
(45) Date of Patent: Nov. 16, 2010

(54) IMAGE FORMING APPARATUS AND CONTROL METHOD THEREOF

(75) Inventors: Myung-ho Kyung, Suwon-si (KR); Kyung-hwan Kim, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 318 days.

(21) Appl. No.: 12/019,176

(22) Filed: Jan. 24, 2008

(65) Prior Publication Data

US 2008/0298828 A1 Dec. 4, 2008

(30) Foreign Application Priority Data

May 30, 2007 (KR) ..... 10-2007-0052550

(51) Int. Cl.
*G03G 15/16* (2006.01)

(52) U.S. Cl. ..... 399/66; 399/50; 399/51

(58) Field of Classification Search ..... 399/38–40, 399/46, 48, 50, 51, 53–55, 66
See application file for complete search history.

(56) References Cited

U.S. PATENT DOCUMENTS

| | | | | |
|---|---|---|---|---|
| 7,113,712 | B2 * | 9/2006 | Gomi | 399/48 |
| 2006/0083527 | A1 * | 4/2006 | Sakamaki | 399/50 |
| 2007/0013924 | A1 * | 1/2007 | Sakai et al. | 358/1.4 |

* cited by examiner

*Primary Examiner*—Hoan Tran
(74) *Attorney, Agent, or Firm*—Stanzione & Kim LLP

(57) ABSTRACT

An image forming apparatus capable of varying a transferring force according to an amount of developer, thereby improving transfer quality, and a control method thereof. The image forming apparatus includes a plurality of photoconductive media on which electrostatic latent images are formed, a transfer unit onto which color developer images respectively developed on the plurality of photoconductive media are transferred and superimposed in sequence, and a controller to control in a manner that electric potential differences between image areas and non-image areas of the electrostatic latent images vary in an order in which the color developer images are transferred.

25 Claims, 7 Drawing Sheets

IMAGE FORMING APPARATUS AND CONTROL METHOD THEREOF

CROSS-REFERENCE TO RELATED APPLICATIONS

This application claims priority under 35 U.S.C. §119 (a) from Korean Patent Application No. 10-2007-0052550, filed on May 30, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus which transfers and superimposes individual color developer images onto a transfer unit, thereby realizing a color image, and a control method thereof.

2. Description of the Related Art

In general, an image forming apparatus, such as a printer, photocopier, facsimile, and multifunction peripheral which incorporates several functions in one device, forms an input image on a printing medium.

Such an image forming apparatus includes a photoconductive medium on which an electrostatic latent image is formed, a developing unit to develop the electrostatic latent image with a developer, a transfer unit to transfer the developed image to a printing medium, a fusing unit to fuse the transferred image onto the printing medium, and a discharge unit to discharge the printing medium to the outside.

Referring to FIG. 1, in order to realize a color image, first through fourth photoconductive media 1, 2, 3, 4 and first through fourth developing units 5, 6, 7, 8 are provided. Color electrostatic latent images are respectively formed on the first through fourth photoconductive media 1, 2, 3, 4, and these color electrostatic latent images are respectively developed into color developer images by the first through fourth developing units 5, 6, 7, 8. These color developer images developed on the first through fourth photoconductive media 1, 2, 3, 4 are transferred and superimposed onto a transfer unit 9 in sequence.

Developers moves from the first through fourth developing units 5, 6, 7, 8 to the first through fourth photoconductive media 1, 2, 3, 4 and then to the transfer unit 9 due to the existence of an electric potential difference.

However, a constant voltage is applied to the photoconductive media 1, 2, 3, 4, the developing units 5, 6, 7, 8, and the transfer unit 9. Also, as the developer images are transferred and superimposed from the first through fourth photoconductive media 1, 2, 3, 4 onto the transfer unit 9, an amount of developer to be transferred increases. However, the developers move between the first through fourth photoconductive media 1, 2, 3, 4 and the transfer unit 9 with the same electric potential difference. As a result, a transferring force does not correspond to the increased amount of developer, which deteriorates transfer quality.

SUMMARY OF THE INVENTION

The present general inventive concept provides an image forming apparatus which increases a transferring force with an increased amount of developer, thereby improving transfer quality, and a control method thereof.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an image forming apparatus including a plurality of photoconductive media to form a image, a transfer unit to transfer color developer images on the plurality photoconductive media and a controller to control in a manner that electric potential differences between image areas and non-image areas of the electrostatic latent images vary in an order in which the color developer images are transferred.

The controller may control laser scanning powers of a plurality of laser scanning units to expose the plurality of photoconductive media to laser beams and form the electrostatic latent images.

The controller may control the laser scanning powers to vary in sequence.

If color developers are charged with a negative voltage and if the plurality of photoconductive media are charged with a negative voltage, the controller may control the laser scanning powers to increase in sequence, and if the color developers are charged with a positive voltage and if the plurality of photoconductive media are charged with a positive voltage, the controller may control the laser scanning powers to decrease in sequence.

The controller may control earth electric potentials of the plurality of photoconductive media.

A plurality of diodes may be connected with grounded portions of the plurality of photoconductive media, and the plurality of diodes may have different capacitances.

The controller may control charging electric potentials applied from a plurality of charging members to charge the plurality of photoconductive media respectively.

The control may control the charging electric potentials to vary in sequence.

If color developers are charged with a negative voltage and if the plurality of photoconductive media are charged with a negative voltage, the controller may control the charging electric potentials to increase in sequence, and if the color developers are charged with a positive voltage and if the plurality of photoconductive media are charged with a positive voltage, the controller may control the charging electric potentials to decrease in sequence.

The controller may control the laser scanning powers of the plurality of laser scanning units and the charging electric potentials applied from the plurality of charging members.

The controller may control the laser scanning powers of the plurality of laser scanning units and the earth electric potentials of the plurality of photoconductive media.

The controller may control the charging electric potentials applied from the plurality of charging members and the earth electric potentials of the plurality of photoconductive media.

The controller may control the laser scanning powers of the plurality of laser scanning units, the earth electric potentials of the plurality of photoconductive media, and the charging electric potentials applied from the plurality of charging members.

The foregoing and/or other aspects and utilities of the general inventive concept may also be achieved by providing a method to control an image forming apparatus, the method including forming color electrostatic latent images on a plurality of photoconductive media, respectively, developing the color electrostatic latent images with color developers, respectively, transferring and superimposing the developed color images onto a transferring member in sequence and controlling in a manner that electric potential differences between image areas and non-image areas of the plurality of photoconductive media vary in an order in which the color images are transferred.

The forming operation may include a plurality of charging members charging the plurality of photoconductive media and a plurality of laser scanning units exposing the plurality of photoconductive media to laser beams.

The controlling operation may include controlling laser scanning powers of the plurality of laser scanning units.

The controlling operation may include controlling charging electric potentials applied from the plurality of charging members.

The controlling operation may include controlling earth electric potentials of the plurality of photoconductive media.

The controlling operation may include controlling the laser scanning powers of the plurality of laser scanning units and the charging electric potentials applied from the plurality of charging members.

The controlling operation may include controlling the laser scanning powers of the plurality of laser scanning units and the earth electric potentials of the plurality of photoconductive media.

The controlling operation may include controlling the charging electric potentials applied from the plurality of charging members and the earth electric potentials of the plurality of photoconductive media.

The controlling operation may include controlling the laser scanning powers of the plurality of laser scanning units, the earth electric potentials of the plurality of photoconductive media, and the charging electric potentials applied from the plurality of charging members.

The foregoing and/or other aspects and utilities of the general inventive concept may also be achieved by providing an image forming apparatus including a plurality of photoconductive media, a plurality of developing units to develop color images on the plurality of photoconductive media, respectively, a transfer unit to receive and superimpose the respective developed color images from the photoconductive media in a sequential order and at least one of a controller and a plurality of electric potential adjusting members to vary electric potential differences between a transfer electric potential and image electrical potentials in the sequential order in which the respective developed color images are received by the transfer unit.

The foregoing and/or other aspects and utilities of the general inventive concept may also be achieved by providing a method to form a color image in an image forming apparatus, the method including forming a plurality of color images on a plurality of photoconductive media, respectively, receiving and superimposing the respective developed color images from the photoconductive media to a transfer unit in a sequential order and generating a transfer force to transfer the respective developed color images from the photoconductive media to the transfer unit so that the transfer force increases corresponding to the sequential order in which the respective developed color images are received by the transfer unit.

The foregoing and/or other aspects and utilities of the general inventive concept may also be achieved by providing a computer-readable recording medium having embodied thereon a computer program to execute a method, wherein the method includes forming a plurality of color images on a plurality of photoconductive media, respectively, receiving and superimposing the respective developed color images from the photoconductive media to a transfer unit in a sequential order and generating a transfer force to transfer the respective developed color images from the photoconductive media to the transfer unit so that the transfer force increases corresponding to the sequential order in which the respective developed color images are received by the transfer unit.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
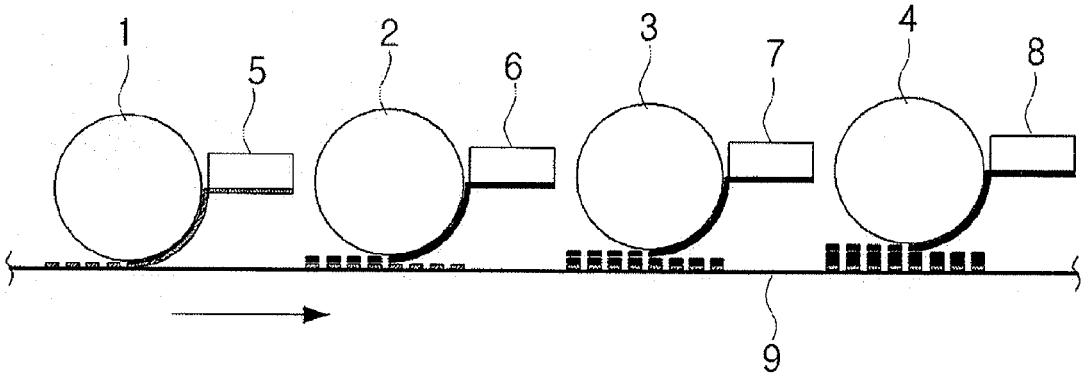
FIG. 1 (PRIOR ART)
FIG. 1 is a view schematically illustrating a transferring operation of a general image forming apparatus.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
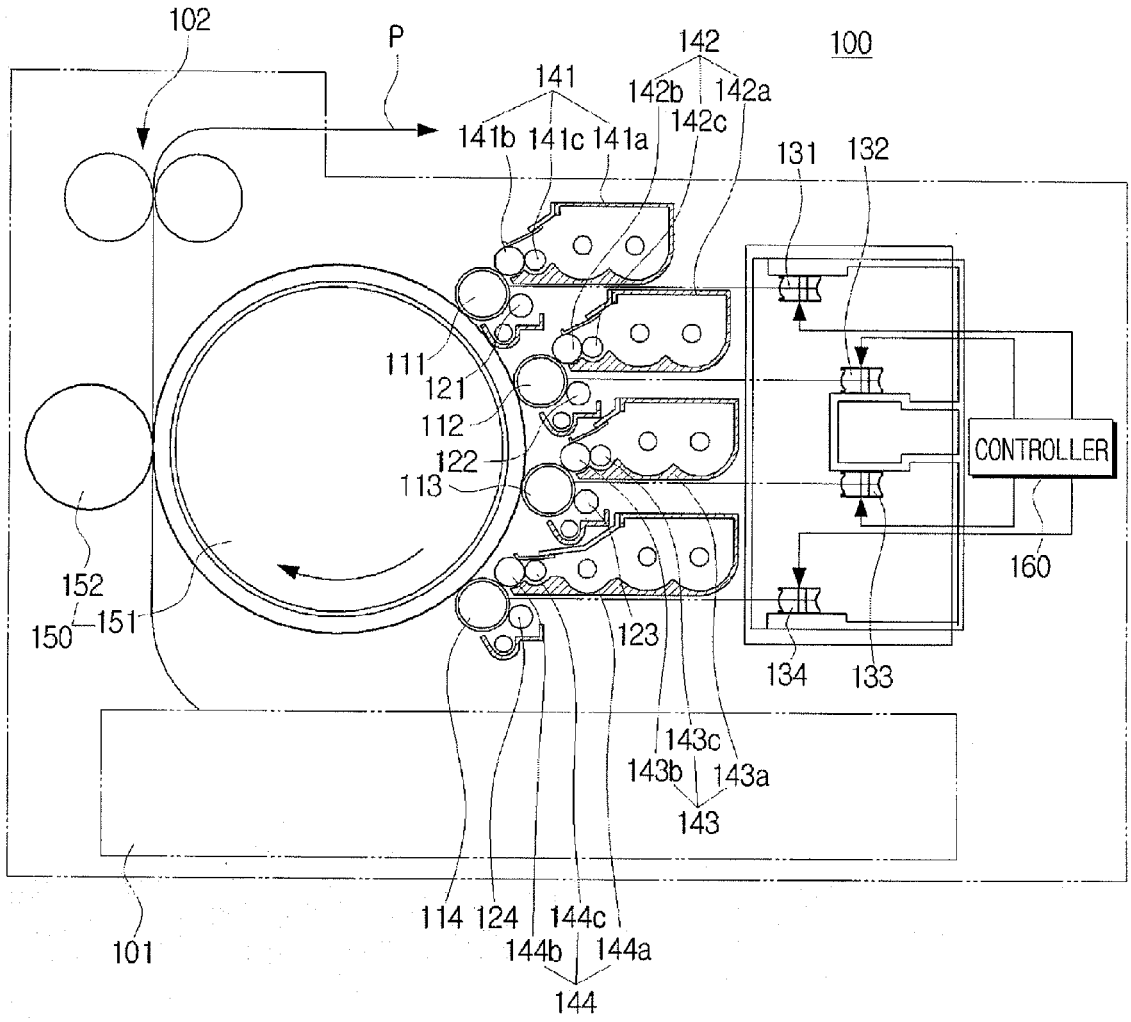
FIG. 2 is a cross section view schematically illustrating an image forming apparatus according to an exemplary embodiment of the present general inventive concept.

Referring to FIG. 2, according to an exemplary embodiment of the present general inventive concept, an image forming apparatus 100 includes first through fourth photoconductive media 111, 112, 113, 114, first through fourth charging members 121, 122, 123, 124, first through fourth laser scanning units 131, 132, 133, 134, first through fourth developing units 141, 142, 143, 144, a transfer unit 150, and a controller 160.

The first through fourth photoconductive media 111, 112, 113, and 114 are drums on which electrostatic latent images corresponding to individual color images are formed.

Figure 3:
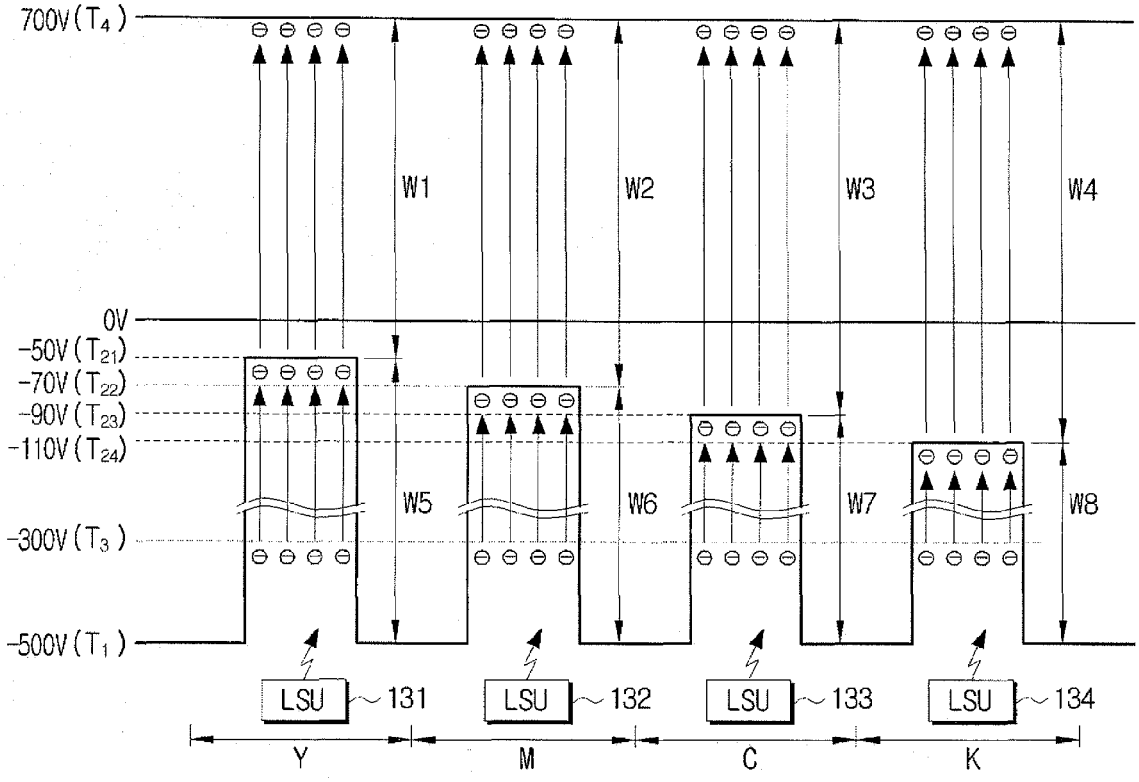
FIG. 3 is a graph illustrating relationships among a charging electric potential, a laser scanning electric potential, a developing electric potential, and a transfer electric potential according to an exemplary embodiment as illustrated in FIG. 2.

The first through fourth charging members 121, 122, 123, 124 charge the first through fourth photoconductive media 111, 112, 113, 114, respectively, with a predetermined electric potential. In this embodiment, a constant charging electric potential Ti of −500V is applied from the first through fourth charging members 121, 122, 123, 124 as illustrated in FIG. 3.

The first through fourth laser scanning units 131, 132, 133, 134 expose surfaces of the first through fourth photoconductive media 111, 112, 113, 114 to laser beams with predetermined laser scanning powers, respectively, thereby forming electrostatic latent images.

More specifically, if the first through fourth laser scanning units 131, 132, 133, 134 scan the surfaces of the first through fourth photoconductive media 111, 112, 113, 114 with laser beams having predetermined laser scanning powers, electrostatic latent images are formed on the surfaces of the first through fourth photoconductive media 111, 112, 113, 114, respectively. The electrostatic latent images are divided into image areas which have been scanned with laser beams to have predetermined image electric potential T21, T22, T23, T24 and non-image areas which have not been scanned with laser beams.

The first through fourth developing units 141, 142, 143, 144 develop the electrostatic latent images formed on the first through fourth photoconductive media 111, 112, 113, 114 using a plurality of color developers. For example, the first through fourth developing units 141, 142, 143, 144 develop yellow, magenta, cyan, and black developer images, respectively.

The first through fourth developing units 141, 142, 143, 144 include first through fourth developing devices 141*a*, 142*a*, 143*a*, 144*a* to contain yellow, magenta, cyan, and black developers, first through fourth developing rollers 141*b*, 142*b*, 143*b*, 144*b* to rotate to opposite the first through fourth photoconductive media 111, 112, 113, 114, and first through fourth supply rollers 141*c*, 142*c*, 143*c*, 144*c* to supply the first through fourth developing rollers 141*b*, 142*b*, 143*b*, 144*b* with the yellow, magenta, cyan, and black developers.

FIG. 3 is a graph illustrating relationships among a charging electric potential, a laser scanning electric potential, a developing electric potential, and a transfer electric potential according to an exemplary embodiment as illustrated in FIG. 2. Referring to FIGS. 2 and 3, a developing electric potential T3 of approximately −300V is constantly applied to the first through fourth developing rollers 141*b*, 142*b*, 143*b*, and 144*b*. The yellow, magenta, cyan, and black developers move onto the electrostatic latent images formed on the first through fourth photoconductive media 111, 112, 113, 114 due to electric potential differences between the developing electric potential T3 and the image electric potentials T21, 122, T23, T24 of the first through fourth photoconductive media 111, 112, 113, 114.

As described above, the first through fourth charging members 121, 122, 123, 124, the first through fourth laser scanning units 131, 132, 133, 134, and the first through fourth developing units 141, 142, 143, 144 configure an image forming section that forms electrostatic latent images on the first through fourth photoconductive media 111, 112, 113, 114, respectively, and develops them with color developers.

The yellow, magenta, cyan, and black developer images developed on the first through fourth photoconductive media 111, 112, 113, 114 are transferred and superimposed onto the transfer unit 150 in sequence, thereby realizing a color image. The transfer unit 150 includes a transfer member 151 onto which the color developer images are transferred and superimposed, and a backup roller 152 to transfer the superimposed images from the transfer member 151 to a printing medium P.

A transfer electric potential T4 of approximately 700V is applied to the transfer member 151 as illustrated in FIG. 3. Therefore, the color developers move toward the transfer member 151 due to electric potential differences W1, W2, W3, W4 between the transfer electric potential T4 and the image electric potentials T21, T22, T23, T24 of the first through fourth photoconductive media 111, 112, 113, 114.

The printing medium P is fed from a paper feeding cassette 101 and passes between the backup roller 152 and the transfer member 151 such that the color image is transferred to the printing medium P. The color image transferred to the printing medium P is fused by the fusing unit 102 and then the printing medium P is discharged to the outside.

The first through fourth photoconductive media 111, 112, 113, 114 and the corresponding first through fourth developing units 141, 142, 143, 144 are arranged in parallel along a rotational direction of the transfer member 151.

Accordingly, the yellow developer image of the first photoconductive medium 111, the magenta developer image of the second photoconductive medium 112, the cyan developer image of the third photoconductive medium 113, and the black developer image of the fourth photoconductive medium 114 are transferred and superimposed onto the transfer member 151 in sequence.

The controller 160 controls such that electric potential differences W5, W6, W7, W8 between the image areas and the non-image areas of the first through fourth photoconductive media 111, 112, 113, 114 decrease in an order in which the color developer images are transferred. For this, the controller 160 controls the laser scanning powers applied from the first through fourth laser scanning units 131, 132, 133, 134 as illustrated in FIG. 3.

More specifically, the controller 160 controls the laser scanning powers of the first through fourth laser scanning units 131, 132, 133, 134 such that the first thorough fourth image electric potentials T21, T22, T23, T24 of the image areas formed on the first through fourth photoconductive media 111, 112, 113, 114 reach −50V, −70V, −90V, and −110V, respectively.

Consequently, there occur first through fourth electric potential differences W1, W2, W3, W4 between the transfer electric potential T4 of 700V constantly applied to the transfer member 151 and the first through fourth image electric potentials T21, T22, T23, T24. This electric potential difference becomes greater from the first electric potential difference W1 to the fourth electric potential difference W4.

Also, there occur the fifth through eighth electric potential differences W5, W6, W7, W8 between the first through fourth image electric potentials T21, T22, T23, T24 of the image area of the first through fourth photoconductive media 111, 112, 113, 114 and the charging electric potential T1 of the non-image areas. This electric potential difference becomes smaller from the fifth electric potential W5 to the eighth electric potential W8.

For reference, sections Y, M, C and K illustrated in FIG. 3 illustrate relationships of the charging electric potential T1, the first through fourth image electric potentials T21, T22, T23, T24, the developing electric potential T3, and the transfer electric potential T4, which involve in developing the yellow, magenta, cyan, black images.

In this embodiment, the developers are charged with a negative voltage, so the charging electric potential T1, the first through fourth image electric potentials T21, T22, T23, T24, and the developing electric potential T3 are negative electric potentials, and the transfer electric potential T4 is a positive electric potential. That is, the color developers and the photoconductive media 111, 121, 131, 141 are charged with a negative voltage.

However, this should not be considered as limiting, and if a developer is charged with a positive voltage, the charging electric potential T1, the image electric potentials T21, T22, T23, T24, and the developing electric potential T3 are positive electric potentials, and the transfer electric potential T4 is a negative electric potential.

Hereinafter, operation of controlling the image forming apparatus according to the exemplary embodiment of the present general inventive concept described above will be described with reference to FIGS. 2 and 3.

Referring to FIGS. 2 and 3, the first through fourth charging members 121, 122, 123, 124 charge the first through fourth photoconductive media 111, 112, 113, 114 with the charging electric potential of −500V. After that, the controller 160 controls the laser scanning powers of the first through fourth laser scanning units 131, 132, 133, 134 such that image areas having the first through fourth image electric potentials T21, T22, T23, T24 of −50V, −70V, −90V, and −110V are formed on the first through fourth photoconductive media 111, 112, 113, 114, respectively.

That is, the first through fourth laser scanning units 131, 132, 133, 134 expose surfaces of the first through fourth photoconductive media 111, 112, 113, 114 to laser beams with the first through fourth electric potentials T21, T22, T23, T24, which are different from one another.

Also, the developing electric potential T3 of −300V is applied to the first through fourth developing units 141, 142, 143, 144. Accordingly, the yellow, magenta, cyan, and black developers contained in the first through fourth developing devices 141*a*, 142*a*, 143*a*, and 144*a* and charged with a negative voltage pass through the supply rollers 141*c*, 142*c*, 143*c*, 144*c* and then through the developing rollers 141*b*, 142*b*, 143*b*, 144*b*, and move onto the laser scanning areas of the first through fourth photoconductive media 111, 112, 113, 114, which are relatively high in the electric potentials, that is, the image areas of the electrostatic latent images. Accordingly, the electrostatic latent images of the first through fourth photoconductive media 111, 112, 113, 114 are developed into the yellow, magenta, cyan, and black developer images, respectively.

The respective color developer images developed on the first through fourth photoconductive media 111, 112, 113, 114 are transferred and superimposed onto the transfer member 151 in sequence due to the electric potential differences between the photoconductive media 111, 112, 113, 114 and the transfer member 151. More specifically, since the transfer electric potential T4 of 700V is applied to the transfer member 151, the yellow developer image formed on the image area of −50V of the first photoconductive medium 111 is transferred to the transfer member 151 due to the first electric potential difference W1. Such a developer image transferring process is performed between the second through fourth photoconductive media 112, 113, 114 and the transfer member 151 in the same way.

The magenta image of the second photoconductive medium 112 is superimposed on the yellow image transferred from the first photoconductive medium 111 to the transfer member 151, the cyan image of the third photoconductive medium 113 is superimposed on the yellow-magenta superimposed image, and then finally, the black image of the fourth photoconductive medium 114 is superimposed on the yellow-magenta-cyan superimposed image.

The controller 160 controls the laser scanning powers and thus controls the image electric potentials T21, T22, T23, T24 such that the fifth through eighth electric potential differences W5, W6, W7, and W8 decrease in that order and the first through fourth electric potential differences W1, W2, W3, and W4 increase in that order.

Accordingly, the transferring force needed in transferring and superimposing the yellow, magenta, cyan, and black developer images becomes relatively greater from the yellow image transferring operation to the black image transferring operation. That is, as the electric potential difference between the image electric potentials T21, T22, T23, T24 and the transfer electric potential T4 increases in the order of W1, W2, W3, and W4, the force for the transfer member 151 to attract the developers increases.

Accordingly, the transferring force increases so as to match up to the increased amount of developers as the yellow, magenta, cyan, and black developer images are superimposed.

As described above, the color image transferred to the transfer member 151 is finally transferred to the printing medium P passing between the backup roller 152 and the transfer member 151, and then the printing medium P with the color image transferred thereto is discharged to the outside after passing through the fusing unit 102.

Figure 4:
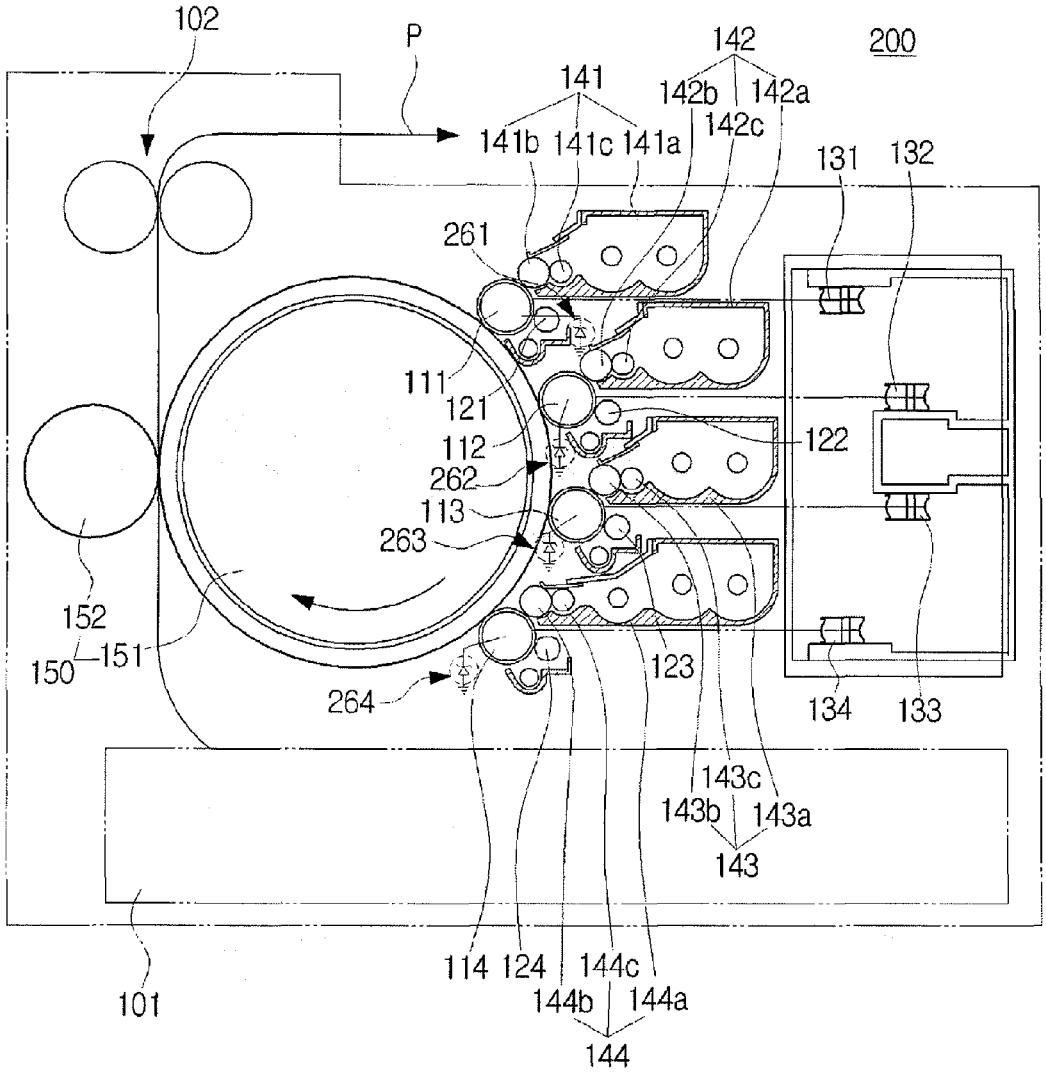
FIG. 4 is a cross section view schematically illustrating an image forming apparatus according to another exemplary embodiment of the present general inventive concept.

FIG. 4 illustrates an image forming apparatus 200 according to another exemplary embodiment of the present general inventive concept.

Referring to FIG. 4, according to the present exemplary embodiment, an image forming apparatus 200 includes first through fourth photoconductive media 111, 112, 113, 114, first through fourth charging members 121, 122, 123, 124, first through fourth laser scanning units 131, 132, 133, 134, first through fourth developing units 141, 142, 143, 144, a transfer unit 150, first through fourth electric potential adjusting members 261, 262, 263, 264, a paper feeding cassette 101, and a fusing unit 102.

The first through fourth photoconductive media 111, 112, 113, 114, the first through fourth charging members 121, 122, 123, 124, the first through fourth laser scanning units 131, 132, 133, 134, the first through fourth developing units 141, 142, 143, 144, the transfer unit 150, the paper feeding cassette 101, and the fusing unit 102 are the same as those of the image forming apparatus 100 of the exemplary embodiment illustrated in FIG. 2 in their technical details, and thus detailed description and illustration will be omitted.

The first through fourth electric potential adjusting members 261, 262, 263, 264, are respectively connected with grounded portions of the first through fourth photoconductive media 111, 112, 113, 114 to adjust earth electric potentials of the first through fourth photoconductive media 111, 112, 113, 114. The first through fourth electric potential adjusting members 261, 262, 263, 264, for example, can be diodes having different capacitances and may be general zenor diodes.

In this embodiment, the first through fourth electric potential adjusting members 261, 262, 263, 264 have their respective capacitances of approximately 0, −20, −40, and −60.

If the first through fourth electric potential adjusting members 261, 262, 263, 264 having different capacitances are respectively connected with the first through fourth photoconductive media 111, 112, 113, 114, they adjust the earth electric potentials of the first through fourth photoconductive media 111, 112, 113, 114 according to their respective capacitances.

More specifically, even if the same laser scanning electric potential is applied to the first through fourth photoconductive media 111, 112, 113, 114 and thus image areas having the same image electric potential of −50V are formed thereon, the first through fourth electric potential adjusting members 261, 262, 263, 264 adjust the electric potentials of the first through fourth photoconductive media 111, 112, 113, 114 to 0, −20, −40, and −60. Accordingly, the electric potentials of the scanned areas of the surfaces of the first through fourth photoconductive media 111, 112, 113, 114, i.e., of the image areas are adjusted to the image electric potentials T21, T22, T23, T24 as illustrated in FIG. 3.

That is, the first through fourth electric potential adjusting members 261, 262, 263, 264 perform the same function as that of the controller 160 of the first embodiment to represent the electric potential relationship graph as illustrated in FIG. 3.

Accordingly, the first through fourth electric potential differences W1, W2, W3, W4 increase and the fifth through eighth electric potential differences W5, W6, W7, W8 decrease so that the transferring force increases so as to match up to the increased amount of developers as the yellow, magenta, cyan, and black developer images are transferred and superimposed.

Figure 5:
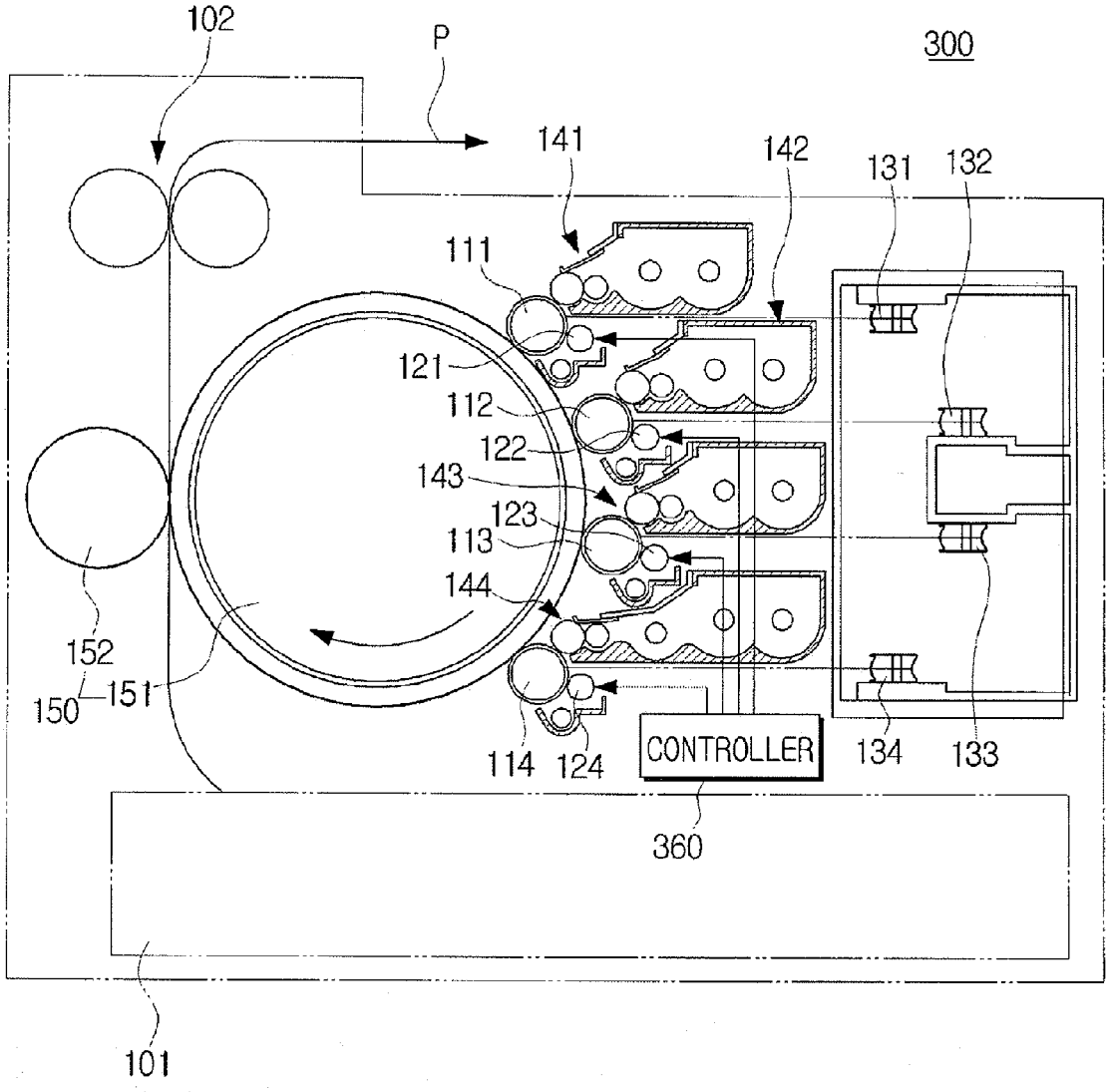
FIG. 5 is a cross section view schematically illustrating an image forming apparatus according to another exemplary embodiment of the present general inventive concept.

FIG. 5 illustrates an image forming apparatus 300 according to another exemplary embodiment of the present general inventive concept.

Referring to FIG. 5, according to the present embodiment of the present general inventive concept, an image forming apparatus 300 includes first through fourth photoconductive media 111, 112, 113, 114, first through fourth charging members 121, 122, 123, 124, first through fourth laser scanning units 131, 132, 133, 134, first through fourth developing units 141, 142, 143, 144, a transfer unit 150, a controller 360, a paper feeding cassette 101, and a fusing unit 102.

The first through fourth photoconductive media 111, 112, 113, 114, the first through fourth charging members 121, 122, 123, 124, the first through fourth laser scanning units 131, 132, 133, 134, the first through fourth developing units 141, 142, 143, 144, the transfer unit 150, the paper feeding cassette 101, and the fusing unit 102 are same as those of the image forming apparatus 100 of the exemplary embodiment illustrated in FIG. 2 in their technical details, and thus detailed description and illustration will be omitted.

Figure 6:
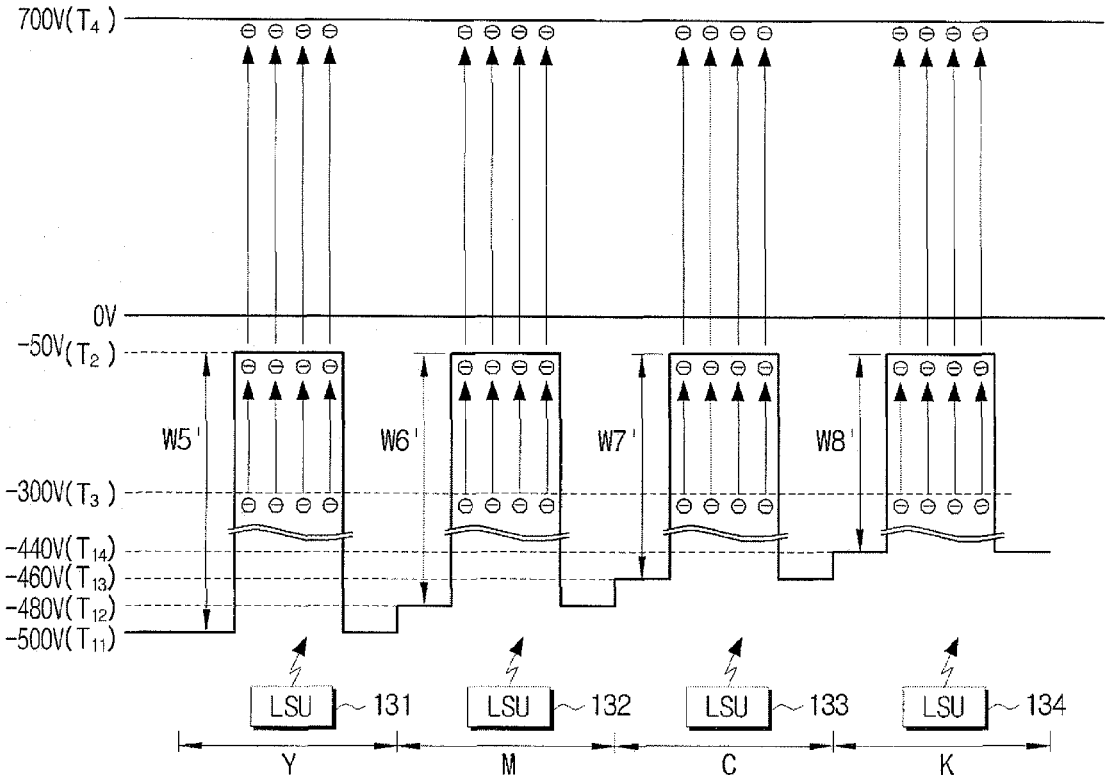
FIG. 6 is a graph illustrating relationships among a charging electric potential, a laser scanning electric potential, a developing electric potential, and a transfer electric potential according to the exemplary embodiment as illustrated in FIG. 5.

The controller 360 controls charging electric potentials T11, T12, T13, T14 of the first through fourth charging members 121, 122, 123, 124 as illustrated in FIG. 6. More specifically, the controller 360 controls charging electric potentials of the surface of the first through fourth photoconductive media 111, 112, 113, 114 before they are exposed to laser beams such that electric potentials T11, T12, T13, T14 of non-image areas which have not been exposed to the laser beams by the first through fourth laser scanning units 131, 132, 133, 134 are adjusted to, for example, −500V, −480V, −460, and −440V.

Accordingly, electric potential differences W5', W6', W7', W8' between the electric potentials T11, T12, T13, T14 of the non-image areas and the electric potential T2 of the image areas become smaller from the first photoconductive medium 111 to the fourth photoconductive medium 114. Accordingly, when yellow, magenta, cyan, and black developer images developed on the first through fourth photoconductive media 111, 112, 113, 114 are transferred and superimposed onto the transfer member 151, it is possible to sequentially reduce the leak of electric potential from the image areas to the non-image areas.

That is, as the electric potential differences W5', W6', W7', W8' between the electric potentials T11, T12, T13, T14 of the non-image areas and the electric potential T2 of the image areas decrease, the force for the non-image area to attract the electric potential of the image area decreases, and thus the interference by the electric potential T2 of the image areas is reduced.

Accordingly, the transferring force increases so as to match up to the increased amount of developers as the yellow, magenta, cyan, and black developer images are transferred and superimposed.

In the various exemplary embodiments, either one of the electric potential of the image area and the electric potential of the non-image area is controlled, but this should not be considered as limiting.

More specifically, the laser scanning powers of the first through fourth laser scanning units 131, 132, 133, 134 may be controlled along with the earth electric potentials of the first through fourth photoconductive media 111, 112, 113, 114, or along with the charging electric potentials of the first through fourth charging members 121, 122, 123, 124.

Also, the earth electric potentials of the first through fourth photoconductive medium 111, 112, 113, 114 and the charging electric potentials of the first through fourth charging members 121, 122, 123, 124 may be controlled, or the laser scanning powers of the first through fourth laser scanning units 131, 132, 133, 134, the earth electric potentials of the first through fourth photoconductive media 111, 112, 113, 114, and the charging electric potentials of the first through fourth charging members 121, 122, 123, 124 may be concurrently controlled.

Figure 7:
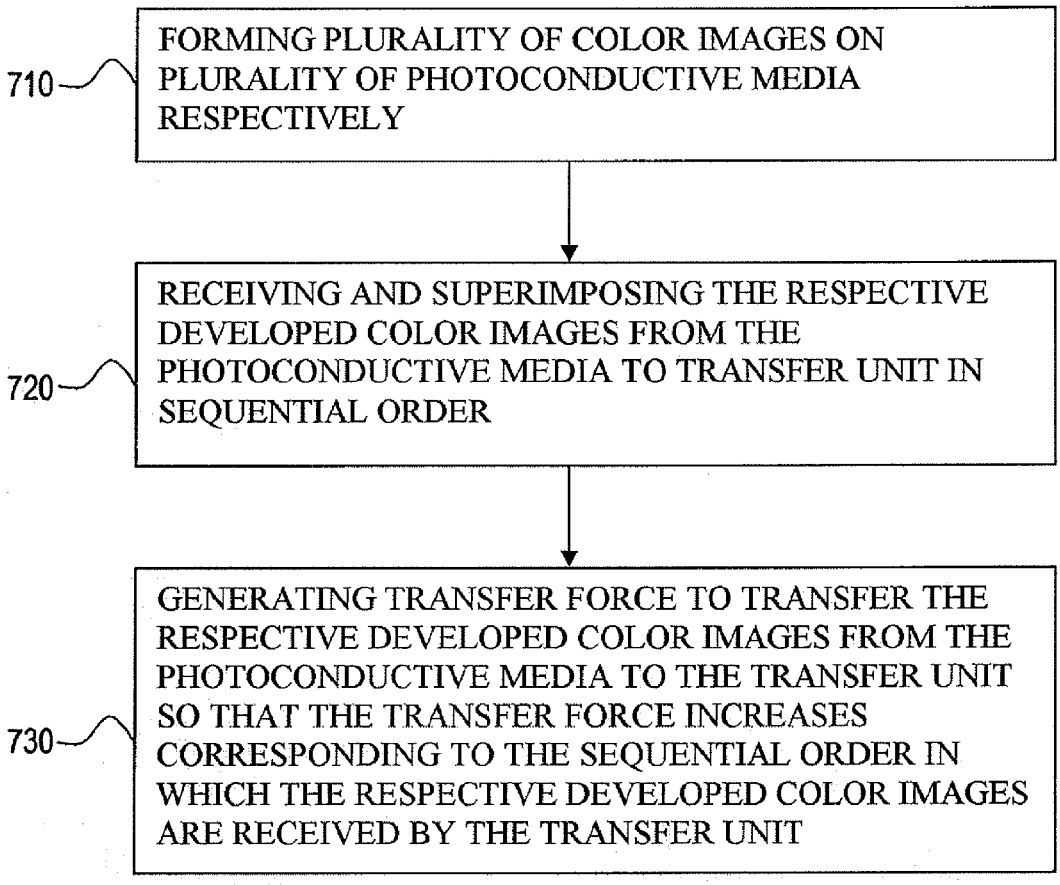
FIG. 7 is a flowchart illustrating a method to form a color image in an image forming apparatus according to an exemplary embodiment of the present general inventive concept.

FIG. 7 is a flowchart illustrating a method to form a color image in an image forming apparatus according to an exemplary embodiment of the present general inventive concept. Referring to FIG. 7, in operation 710, a plurality of color images is formed on a plurality of photoconductive media, respectively. In operation 720, the respective developed color images from the photoconductive media is received and superimposed to a transfer unit in a sequential order. In operation 730, a transfer force to transfer the respective developed color images from the photoconductive media to the transfer unit is generated so that the transfer force increases corresponding to the sequential order in which the respective developed color images are received by the transfer unit.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

According to exemplary embodiments of the present general inventive concept as described above, an electric potential difference between an image area and a non-image area decreases in sequence so as to match up to an increased amount of developers, thereby allowing a transferring force to increase in the order in which transferring operations are performed. Accordingly, the force for a transfer member to attract the developers during the operation of transferring and superimposing the color developer images gradually increases, and thus transfer quality is improved.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a plurality of photoconductive media to form an image;

a transfer unit to transfer color developer images on the plurality of photoconductive media; and a controller to control in a manner that electric potential differences between image areas and non-image areas of electrostatic latent images vary in an order in which the color developer images are transferred.

2. The image forming apparatus as claimed in claim 1, wherein the controller controls laser scanning powers of a plurality of laser scanning units to expose the plurality of photoconductive media to laser beams and form the electrostatic latent images.

3. The image forming apparatus as claimed in claim 2, wherein the controller controls the laser scanning powers to vary in sequence.

4. The image forming apparatus as claimed in claim 3, wherein if the color developers are charged with a negative voltage and if the plurality of photoconductive media are charged with a negative voltage, the controller controls the laser scanning powers to increase in sequence, and if the color developers are charged with a positive voltage and if the plurality of photoconductive media are charged with a positive voltage, the controller controls the laser scanning powers to decrease in sequence.

5. The image forming apparatus as claimed in claim 2, wherein the controller controls charging electric potentials applied from a plurality of charging members to charge the plurality of photoconductive media respectively.

6. The image forming apparatus as claimed in claim 1, wherein the controller controls charging electric potentials applied from a plurality of charging members to charge the plurality of photoconductive media respectively.

7. The image forming apparatus as claimed in claim 6, wherein the controller controls the charging electric potentials to vary in sequence.

8. The image forming apparatus as claimed in claim 7, wherein if the color developers are charged with a negative voltage and if the plurality of photoconductive media are charged with a negative voltage, the controller controls the charging electric potentials to increase in sequence, and if the color developers are charged with a positive voltage and if the plurality of photoconductive media are charged with a positive voltage, the controller controls the charging electric potentials to decrease in sequence.

9. The image forming apparatus as claimed in claim 1, wherein the controller controls earth electric potentials of the plurality of photoconductive media.

10. The image forming apparatus as claimed in claim 9, wherein a plurality of diodes having different capacitances are connected with grounded portions of the plurality of photoconductive media.

11. The image forming apparatus as claimed in claim 9, wherein the controller controls charging electric potentials applied from a plurality of charging members to charge the plurality of photoconductive media respectively.

12. A method to control an image forming apparatus, the method comprising:

forming color electrostatic latent images on a plurality of photoconductive media, respectively;

developing the color electrostatic latent images with color developers, respectively;

transferring and superimposing the developed color images onto a transferring member in sequence; and controlling in a manner that electric potential differences between image areas and non-image areas of the plurality of photoconductive media vary in an order in which the color images are transferred.

13. The method as claimed in claim 12, wherein the forming operation comprises:

charging the plurality of photoconductive media by a plurality of charging members; and exposing the plurality of photoconductive media to laser beams by a plurality of laser scanning units.

14. The method as claimed in claim 13, wherein the controlling operation comprises:

controlling laser scanning powers of the plurality of laser scanning units.

15. The method as claimed in claim 14, wherein the controlling operation comprises:

if the color developers are charged with a negative voltage and if the plurality of photoconductive media are charged with a negative voltage, controlling the laser scanning powers to increase in sequence, and if the color developers are charged with a positive voltage and if the plurality of photoconductive media are charged with a positive voltage, controlling the laser scanning powers to decrease in sequence.

16. The method as claimed in claim 14, wherein the controlling operation comprises:

controlling the earth electric potentials of the plurality of photoconductive media using a plurality of diodes having different capacities which are connected with grounded portions of the plurality of photoconductive media.

17. The method as claimed in claim 14, wherein the controlling operation comprises:

controlling charging electric potentials applied from the plurality of charging members.

18. The method as claimed in claim 13, wherein the controlling operation comprises:

controlling charging electric potentials applied from the plurality of charging members.

19. The method as claimed in claim 18, wherein the controlling operation comprises:

if the color developers are charged with a negative voltage and if the plurality of photoconductive media are charged with a negative voltage, controlling the charging electric potentials to increase in sequence, and if color developers are charged with a positive voltage and if the plurality of photoconductive media are charged with a positive voltage, controlling the charging electric potentials to decrease in sequence.

20. The method as claimed in claim 13, wherein the controlling operation comprises:

controlling earth electric potentials of the plurality of photoconductive media.

21. The method as claimed in claim 20, wherein the controlling operation comprises:

controlling the earth electric potentials of the plurality of photoconductive media using a plurality of diodes having different capacities which are connected with grounded portions of the plurality of photoconductive media.

22. An image forming apparatus, comprising:

a plurality of photoconductive media;

a plurality of developing units to develop color images on the plurality of photoconductive media, respectively;

a transfer unit to receive and superimpose the respective developed color images from the photoconductive media in a sequential order; and at least one of a controller and a plurality of electric potential adjusting members to vary electric potential differences between a transfer electric potential and image electrical potentials in the sequential order in which the respective developed color images are received by the transfer unit.

23. The image forming apparatus of claim 22, wherein the electric potential differences increase in the sequential order the developed color images are received by the transfer unit.

24. A method to form a color image in an image forming apparatus, the method comprising:

forming a plurality of color images on a plurality of photoconductive media, respectively;

receiving and superimposing the respective developed color images from the photoconductive media to a transfer unit in a sequential order; and generating a transfer force to transfer the respective developed color images from the photoconductive media to the transfer unit so that the transfer force increases corresponding to the sequential order in which the respective developed color images are received by the transfer unit.

25. A computer-readable recording medium having embodied thereon a computer program to execute a method, wherein the method comprises:

forming a plurality of color images on a plurality of photoconductive media, respectively;

receiving and superimposing the respective developed color images from the photoconductive media to a transfer unit in a sequential order; and generating a transfer force to transfer the respective developed color images from the photoconductive media to the transfer unit so that the transfer force increases corresponding to the sequential order in which the respective developed color images are received by the transfer unit.

* * * * *